US006158345A

United States Patent [19]

Gelbart

[11] Patent Number: 6,158,345

[45] Date of Patent: Dec. 12, 2000

[54] METHOD OF COMPENSATING IMAGE DETAILS FOR FLEXOGRAPHIC PRINTING PLATES

[75] Inventor: Daniel Gelbart, Vancouver, Canada

[73] Assignee: Creo SRL, Burnaby, Canada

[21] Appl. No.: 09/325,665

[22] Filed: Jun. 1, 1999

[51] Int. Cl.[7] ..... B41F 1/34; B41F 21/12; B41F 21/14; B41N 1/00; B41N 6/00

[52] U.S. Cl. ..... 101/485; 101/395; 101/401.1; 101/486; 430/300; 430/301; 430/306; 430/307; 382/275; 382/293

[58] Field of Search ..... 101/395, 401.1, 101/463.1, 483, 485, 486, 211, DIG. 36; 205/69, 666; 216/10, 94; 430/49, 204, 300–310; 522/2; 364/474.08, 474.29; 382/275, 293, 287; 358/298

[56] References Cited

U.S. PATENT DOCUMENTS 4,019,436 4/1977 Handweiler et al. ..... 101/463

5,713,288 2/1998 Frazzitta ..... 101/492

FOREIGN PATENT DOCUMENTS 1005060A 4/1993 Belgium .

81/02346 8/1981 WIPO .

*Primary Examiner*—Kimberly Asher

*Attorney, Agent, or Firm*—Oyen Wiggs Green & Mutala

[57] ABSTRACT

A method for compensating for image distortion imparted on a flexographic printing plate is disclosed. The compensation scheme reduces the distortion effect caused by stretching of the image when the printing plate is wrapped around the cylindrical drum of a printing press. The compensation scheme predicts the localized distortion on different parts of the image caused by variations in the undercut depth and density of the image features on the plate. By so doing, the scaling factor is varied in accordance with the predicted localized distortion in the different parts of the image, so as to minimize the distortion effect over the entire printing plate.

6 Claims, 3 Drawing Sheets

METHOD OF COMPENSATING IMAGE DETAILS FOR FLEXOGRAPHIC PRINTING PLATES

FIELD OF THE INVENTION

This invention relates to flexographic printing and, more specifically, to a method of compensating image distortion imparted onto a flexographic printing plate, so as to improve the quality of the image produced when the plate is employed on the cylindrical drum of a printing press.

BACKGROUND OF THE INVENTION

When flexographic printing plates are mounted on the cylindrical drum of a printing press, a non-linear image distortion is created on the outer (image bearing) surface of the plate. Such a distortion is caused by the stretching of the plate when it is wrapped around the cylindrical drum. This stretching effect is illustrated in FIGS. 1*a* and 1*b*. This is not to be confused with the uniform stretching caused simply by bending any materials into cylindrical shape, also known as the "k factor" in flexography.

FIGS. 1*a* and 1*b* depict typical flexographic plates. Each plate 10 consists of a substrate 12 and an elastomeric, image carrying layer 11. On a flexographic plate, the elastomeric material 11 contains image features 14 which are cut into its exterior 17. The depth and density of the features 14 are dependent on the image data. The depth and density determine the effective average thickness of the elastomeric layer 11. In the following disclosure, the phrases "depth and density" and "effective thickness" are used interchangeably. A relatively high "depth and density" corresponds to a relatively low "effective thickness" and a relatively low "depth and density" corresponds to a relatively high "effective thickness".

As shown in FIG. 1*b*, when a plate 10 is wrapped around the cylindrical drum 15 of a printing press (not shown), stretching occurs on its outer, image bearing surface 17 and compression occurs on its inner, substrate surface 16. On the neutral plane (represented by hash line 13) no stretching or compression occurs. The neutral plane 13 is located a distance $t_2$ from the substrate side of the plate 16 and a distance $t_1$ from the image side of the plate 17. Typically, the substrate 12 is made of a material which is less pliant than that of the elastomeric image carrying area 11; consequently, $t_2$ is less than $t_1$. However, as can be seen by comparing FIG. 1*a* to FIG. 1*b*, the depth and density of image reliefs 14 (or effective thickness of the elastomeric layer) also affects the location of the neutral plane 13. A lower effective thickness of elastomer results in a neutral plane 13 which is located closer to the substrate side 16 of the plate (i.e. $t_1$ increases and $t_2$ decreases with the depth and density of image gravures 14).

When the plate 10 is wrapped around the cylindrical drum 15 of a printing press, stretching occurs on its outer, image bearing surface 17 and compression occurs on its inner surface 16. Because of this stretching, the printed image will exhibit a distortion proportional to the stretching of the image bearing surface 17. Obviously, this distortion degrades the quality of the printed image. As such, there is required in the art a method of minimizing the distortion caused by stretching of the flexographic printing plate as it is mounted on the cylindrical drum of a printing press. This non-linear distortion is particularly apparent when different plates have to register together, such as when printing with more than one color.

In prior art techniques of imaging a flexographic plate 10, the image imparted onto the plate 10 may be reduced by a constant amount so as to compensate for this stretching effect. However, constant compensation over the entire plate 10 does not account for localized deviations in the depth of the neutral plane 13 and the localized distortion of the image bearing surface 17 caused by variations in the effective thickness of the elastomer. This is illustrated by a linear scale 18 showing the effect of local distortion. As such, there is a need in the art for a compensation technique for the imaging of flexographic plates, which minimizes the distortion caused by stretching and accounts for localized variations in the depth and density of image relief.

It is an object of this invention to create a compensation scheme wherein the aforementioned stretching distortion can be reduced, so as to improve the quality of the printed images from a flexographic printing press.

It is a further object of this invention to create a compensation scheme, which predicts localized distortion at various parts of the image and accounts for localized variations in relief depth and density on the image bearing surface of the plate.

SUMMARY OF THE INVENTION

In accordance with the present invention, a method of compensating image details imparted onto a flexographic printing plate is disclosed. The compensation scheme corrects for non-linear distortion created when the plate is wrapped around the cylindrical drum of a printing press. The method comprises the steps of:

(a) predicting a localized distortion in different regions of the image using image data; and (b) applying a variable scaling factor to the different regions the image while imparting the image onto the printing plate.

The scaling factor depends on the predicted localized distortion and compensates the image such that when the image is imparted onto the printing plate, the distortion is minimized.

Advantageously, the predicting step may accomplished by employing image data to estimate distortion caused by localized relief depth and density. The predicting step may further comprise using a low-pass filter or a moving average filter to ensure that the estimated distortion is localized to the different regions of the image. The predicting step may also involve estimating the depth of a neutral plane in the different regions of the image, based on a model of the plate stiffness and elastic characteristics. Such modeling can be performed using Finite Element Analysis (FEA).

Alternatively, or in combination with the other techniques, the predicting step may be accomplished by comparison of localized relief depth and density in the image data to relief depth and density on a test plate. The test plate has a plurality of test regions, each of which has a known relief depth and density. After the test plate has been used to create images, the actual distortion in the test plate images, after it was shaped into a cylinder, can be measured such that distortion is known in each of the test regions.

Once again, a low pass filter or a moving average filter may be employed to ensure that the comparison of relief depth and density in the image data to relief depth and density on the test plate is localized to the different regions of the image.

DESCRIPTION OF THE PREFERRED EMBODIMENT

Figure 1A:
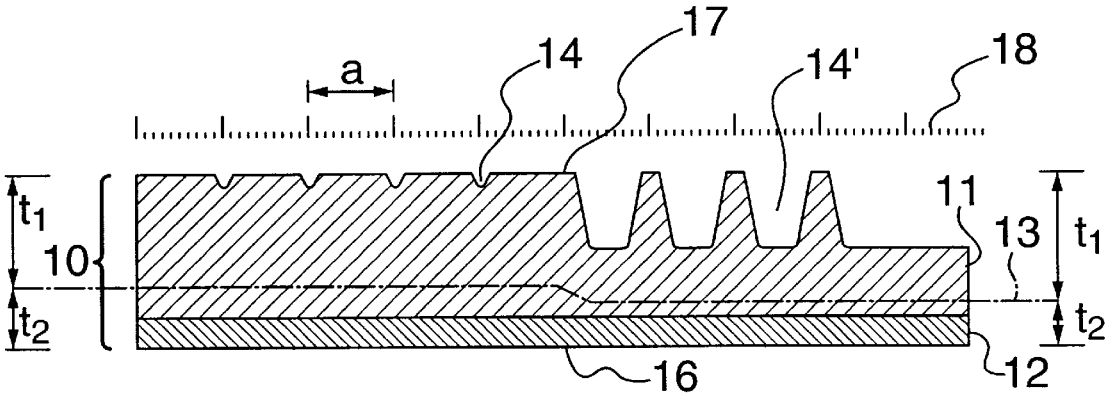
FIGS. 1*a* and 1*b* depict a flexographic plate lying flat and the resultant distortion caused by stretching when the plate is mounted to the cylindrical drum of the printing press. Two different regions are shown, each with a different effective thickness of the elastomeric layer.
Figure 1B:
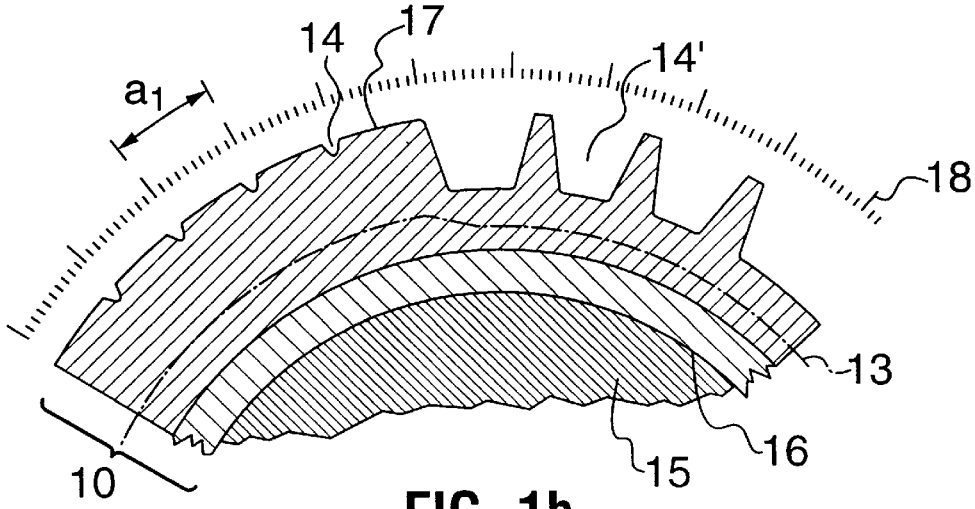

Referring to FIGS. 1*a* and 1*b*, when the plate 10 is wrapped around the cylindrical drum 15 of a printing press, stretching occurs on its outer, image bearing surface 17 and compression occurs on its inner surface 16. If R is the radius of the drum 15, then the overall plate size at the neutral plane 13 (assuming the plate 10 completely covers the circumference of the drum 15) is given by:

$$\text{plate size}=2\pi(R+\overline{t_2}) \tag{1}$$

where $\overline{t_2}$ is the average $t_2$ on the plate 10. The stretch on the image bearing surface 17 of the plate is given by:

$$\text{stretch}=2\pi(R+t_1+t_2)-2\pi(R+\overline{t_2})\approx 2\pi(t_1) \tag{2}$$

Accordingly, the fractional distortion correction at the image bearing surface 17 is:

$$\text{fractional distortion}=\frac{2\pi(t_1)}{2\pi(R+\overline{t_2})}=\frac{t_1}{R+\overline{t_2}} \tag{3}$$

In FIG. 1*a*, there is an image feature which has the size a when the plate 10 is flat. Due to stretching, when the plate 10 is mounted on the drum 15, the parameter a is increased in size to $a_1$. This stretching is indicated in FIG. 1*b*, where $a_1$ is given by:

$$a_1=a+a\left(\frac{t_1}{R+\overline{t_2}}\right)=a\left(1+\frac{t_1}{R+\overline{t_2}}\right) \tag{4}$$

To correct for this distortion effect when the plate is imaged, the parameter a may be reduced by an amount proportional to the fractional distortion. That is, the feature a is compensated, to become $a_{comp}$, where:

$$a_{comp}=\frac{a}{1+\frac{t_1}{R+\overline{t_2}}} \tag{5}$$

In this manner, when the compensated feature is stretched, the result will be:

$$a_{1,comp}=a_{comp}\left(1+\frac{t_1}{R+\overline{t_2}}\right)=\frac{a}{\left(1+\frac{t_1}{R+\overline{t_2}}\right)}\left(1+\frac{t_1}{R+\overline{t_2}}\right)=a \tag{6}$$

Thus, when compensated in accordance with equation (5), the resultant feature size (i.e. after stretching) is the desired size a. Today a uniform factor, also known as a "k factor" is used for the whole plate, independent of the local image features on the plate.

Referring now to FIGS. 1*b*, the distortion effect is shown for relatively high relief depth and density 14'. Here, the parameter $t_1$ is much greater than the corresponding parameter around features 14. (i.e. the neutral plane 13 is much closer to the substrate 12). Consequently, the stretching distortion (as given by equation (3)) is much greater. If the image is still compensated in accordance with equation (5), using an average and constant $t_2$ for the whole image, the misregistration between deep relief features 14' and the linear scale 18 is apparent, even after applying a uniform scaling factor.

Figure 2A:
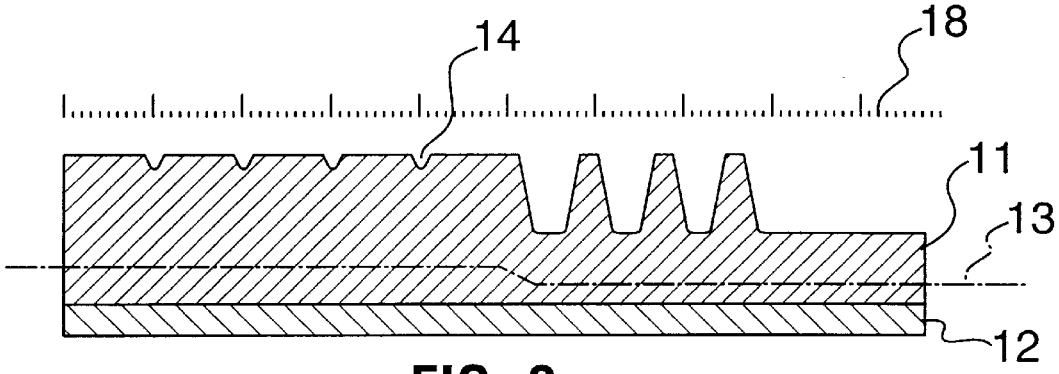
FIGS. 2*a* and 2*b* depict a plane view and a cross-section of a flexographic printing corrected for local distortion according to the invention.
Figure 2B:
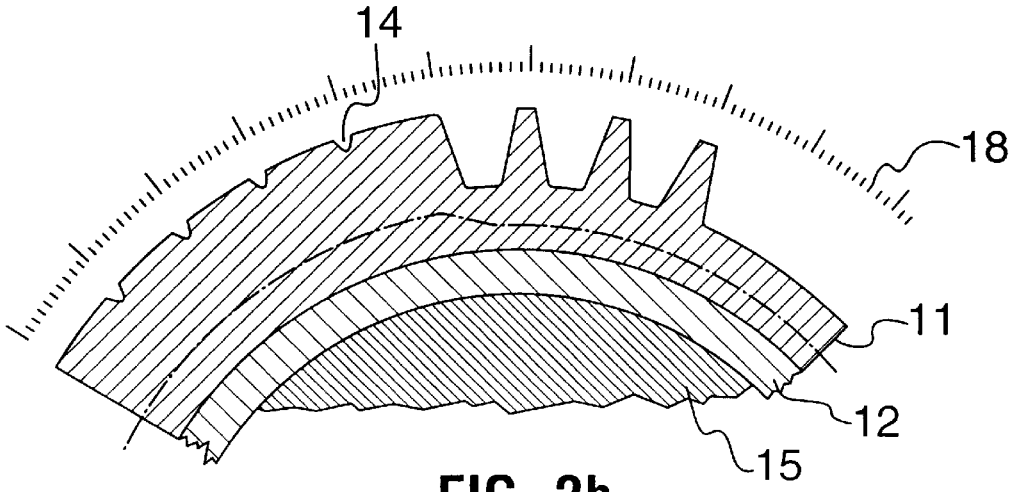

In the present invention, the compensation is introduced when the plate is imaged (i.e. when the desired image is imparted onto the printing plate). Compensation following equation (5) requires knowledge of the parameters $t_1$ and $\overline{t_2}$. In modern printing processes, image data is transferred digitally to the printing plate. As such, the processor controlling the imaging of the plate has access to the image data, such that $t_1$ and $\overline{t_2}$ can be predicted from the density and depth of the reliefs contained in the image. When placement of features is compensated according to equation (5), the plate appears distorted when flat, as shown in FIG. 2*a* but becomes distortion free when mounted on cylinder 15 in FIG. 2*b* . Distortion can be seen by comparing location of features to linear scale 18.

Figure 3A:
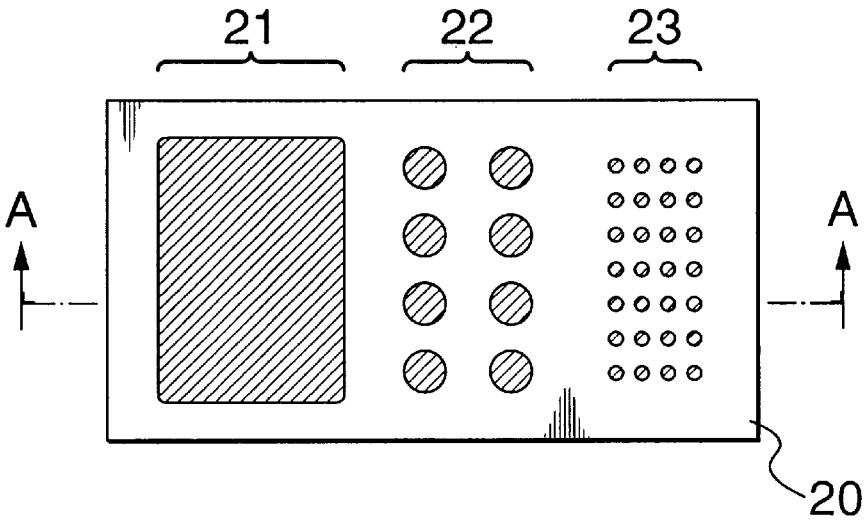
FIGS. 3*a* and 3*b* are respectively a plan view and a cross-sectional view of a plate having different image zones for use in determining empirically a parameter for use in the invention.
Figure 3B:
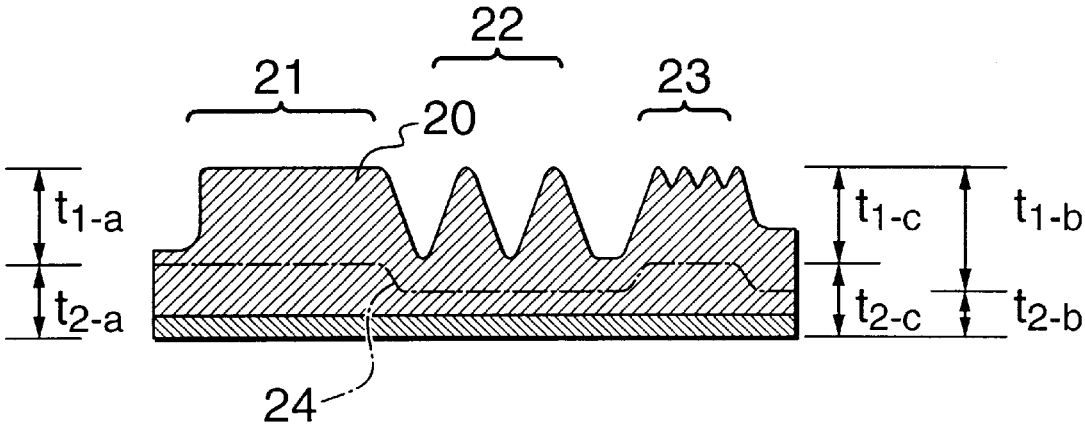

The parameter $t_1$ may be predicted as a function of the image data through estimation or alternatively through testing. FIGS. 3*a* and 3*b* depicts a testing apparatus that could be used to empirically determine $t_1$. FIG. 3*a* shows a plan view of a plate 20 with three different image zones 21, 22 and 23. FIG. 3*b* displays the cross section of the plate 20 along the line A—A. FIG. 3*b* clearly shows how the location of the neutral plane 24 (i.e. the quantity $t_1$) varies with the differing relief depth and density. In zone 21, there is no relief, so the quantity $t_{1-a}$ is relatively small. In zone 22, the reliefs are much deeper and more dense; as a result, the quantity $t_{1-b}$ is larger. In zone 23, the reliefs are dense but not deep (typical of a fine screen) and so $t_{1-c}$ is in between that of zones 21 and 22. By employing testing plates of this type in a test printing run, the stretching of the image features in the various zones may be measured. Obviously, more than three zones can be used for such a test run.

From the stretching distortion measured using the test plate, the location of the neutral plane (i.e. the quantity $t_1$) can be determined for each zone on the test plate. When digital image data is used to transfer an image onto an end run printing plate, the data concerning relief depth and density may be categorized according to its similarity with a particular test zone. Various regions of the image data for the end run plate can be ascribed $t_1$ values from the corresponding zones of the test plate. Since the total thickness of the plate ($t_1$+$t_2$) is a known constant, $\overline{t_2}$ may also be calculated for the end run plate. The compensation scheme may then employ the experimentally determined $t_1$ and $\overline{t_2}$ values according to equation (5) to correct for the stretching distortion on the end run printing plate.

Repeating a test such as this may also permit the derivation of an empirical relation which estimates the connection between the parameters $t_1$ and $\overline{t_2}$ and the relief depth and density. Such an empirical relation could be used to determine the compensation scheme for various regions of the end run printing plate from the image data.

While $\overline{t_2}$ is an average parameter (i.e. averaged over the entire printing plate), $t_1$ is a localized parameter (dependent on the localized relief depth and density). The $t_1$ value and the depth of the neutral plane at a particular point on the image, are also dependent on the relief depth and density in the surrounding areas. As such, $t_1$ should be determined from the relief depth and density on a "moving average" or low pass filter type basis. According to such a scheme, $t_1$ at a particular image location is determined by averaging data regarding the relief depth and density from the surrounding areas. Such a scheme incorporates the effect of the neighboring image areas on the depth of the neutral plane.

The present invention has been described with reference to a particular technique for determining a compensation scheme by measuring the distortion effect caused by the relief depth and density on a test plate and then comparing the results to image data. However, the principles of the present invention are more general and should be understood to include any compensation scheme which uses image data to predict the localized distortion on the various portions of the image bearing surface and employs those predictions to vary the compensation levels in a manner which minimizes the distortion over the entire plate.

It should be understood that the above description is intended for illustrative purposes only, and is not intended to limit the scope of the present invention in any way. Those skilled in the art will appreciate that various modifications can be made to the embodiments discussed above without departing from the spirit of the present invention.

What is claimed is:

1. A method for compensating image details imparted onto a flexographic printing plate to correct for non-linear distortion created when said printing plate is wrapped around a cylindrical drum of a printing press, said method comprising:

(a) predicting a localized distortion in different regions of an image using image data, the image data determining depths of relief features in said image and the localized distortion predicted at least in part from the depths of the relief features; and (b) applying a variable scaling factor to the different regions of said image while imparting said image onto said printing plate, said scaling factor being dependent on said predicted localized distortion, said scaling factor compensating said image, such that when said image is printed by said printing press, said distortion is minimized.

2. A method for compensating image details imparted onto a flexographic printing plate to correct for non-linear distortion created when said printing plate is wrapped around a cylindrical drum of a printing press, said method comprising the steps of:

(a) predicting a localized distortion in different regions of an image using image data; and (b) applying a variable scaling factor to the different regions of said image while imparting said image onto said printing plate, said scaling factor being dependent on said predicted localized distortion, said scaling factor compensating said image, such that when said image is printed by said printing press, said distortion is minimized wherein said predicting step is accomplished by employing image data to estimate distortion caused by localized relief depth and density.

3. A method according to claim 2, wherein said predicting step further comprises using one of: a low-pass filter and a moving average filter to avoid abrupt changes in said localized scaling factor.

4. A method according to claim 2, wherein said predicting step further comprises estimating the depth of a neutral plane in the different regions of said image.

5. A method for compensating image details imparted onto a flexographic printing plate to correct for non-linear distortion created when said printing plate is wrapped around a cylindrical drum of a printing press, said method comprising the steps of:

(a) predicting a localized distortion in different regions of an image using image data; and (b) applying a variable scaling factor to the different regions of said image while imparting said image onto said printing plate, said scaling factor being dependent on said predicted localized distortion, said scaling factor compensating said image, such that when said image is printed by said printing press, said distortion is minimized wherein said predicting step is accomplished by comparison of said image details to image details of a test plate, said test plate comprising a plurality of test regions, each of said test regions having known image details, and said test plate having previously been used for measurement of localized distortion so that said distortion is known for different types of image details.

6. A method according to claim 5, wherein said predicting step further comprises using one of: a low pass filter and a moving average filter to avoid abrupt changes in said localized scaling factor.

* * * * *